United States Patent [19]

Wamester

[11] 3,985,176

[45] Oct. 12, 1976

[54] UNITARY PATTERN ASSEMBLY METHOD

[75] Inventor: Douglas Merrill Wamester, Bolton, Conn.

[73] Assignee: United Technologies Corporation, Hartford, Conn.

[22] Filed: Jan. 5, 1976

[21] Appl. No.: 646,805

[52] U.S. Cl. ..... 164/45; 264/220; 264/225

[51] Int. Cl.[2] ..... B22C 7/02

[58] Field of Search ..... 164/45, 235, 241, 242, 164/243, 246, 236; 249/62; 264/220, 225, 275

[56] References Cited

UNITED STATES PATENTS

| | | | |
|---|---|---|---|
| 2,844,855 | 7/1958 | Godd et al. | 164/10 |
| 3,029,485 | 4/1962 | McCormick | 164/246 |
| 3,254,379 | 6/1966 | Poe | 164/246 X |
| 3,766,966 | 10/1973 | Perisse | 164/45 UX |
| 3,848,654 | 11/1974 | Boyle et al. | 164/246 X |

*Primary Examiner*—Ronald J. Shore
*Attorney, Agent, or Firm*—Edward J. Timmer

[57] ABSTRACT

This invention involves a method of making a unitary pattern assembly which is useful in forming an investment shell mold having an integral base for the conventional and directional solidification of molten metals and alloys. It comprises providing a yoke having a pattern capturing means and two leg members, providing a mold structure having a cavity comprising a pattern section and base section, positioning the mold structure and yoke to expose the capturing means and leg members to the pattern section and base section, respectively, forming a pattern having a base integral therewith in the cavity and removing the mold structure from the pattern and integral base. A unitary pattern assembly comprising a yoke and pattern, having an integral base, fixedly captured therein is obtained. The method is especially suitable for making a pattern assembly useful in the production of gas turbine engine blades by the "lost wax" process.

10 Claims, 3 Drawing Figures

UNITARY PATTERN ASSEMBLY METHOD

BACKGROUND OF THE INVENTION

1. Field of Invention

This invention relates to a method for making a unitary pattern assembly useful in investment casting and, more particularly, to a method for making a unitary pattern assembly useful in forming investment shell molds having an integral base, for the conventional and directional solidification of molten metals and alloys.

2. Description of the Prior Art

The present invention finds particular application in the production of gas turbine engine blades and like components. Turbine blades have been produced primarily by the method known as the "lost wax" process in which a wax pattern of the blade is provided and thereafter repeatedly dipped in a ceramic slurry, such as a zircon slurry, and dried until a shell of adequate thickness is formed thereon. The shelled pattern is then heated to a temperature that will melt the wax so that it flows out of the shell leaving behind a shell mold into which molten metal is poured and either conventionally or directionally solidified to produce the turbine blade. Obviously, the formation and maintenance of the wax pattern in the exact replica of the turbine blade is crucial in achieving a satisfactory casting, since any distortion in the wax pattern will be manifested in the shell mold formed therearound and in the subsequently cast turbine blade.

In the practice of the prior art, distortion of the wax pattern occurs most frequently during the manual assembly of the pattern assembly components. For example, it is common practice to form the pattern in a mold and manually remove the pattern therefrom. The pattern is joined to a wax-coated metal support base, a sprue and runners are then joined to the pattern and a pour cup is thereafter joined to the sprue, the joining usually being done manually by wax welding. A handle is generally wax welded to the pour cup to provide a means for manipulating the pattern assembly during shell mold formation operations. If the assembly is structurally weak, a wax-coated metal support plate may be wax welded to the pour cup and waxcoated metal rods welded between the support base and support plate. This assembly procedure is one of the most critical operations in the entire investment casting process; if improperly done so as to distort the pattern, it can be a major cause of defective castings.

In efforts to overcome the inadequacies in the prior art practice, other workers have reported one-step and two-stp injection molding processes for making a pattern assembly. In the one-step injection molding process, the pattern, runner and pour cup are formed as a one-piece assembly by the injection of molten wax into a suitable die in which a metal pour cup insert has been placed. After formation of the pattern assembly, a ceramic ring is wax welded to the pour cup to provide location and mechanical support means for subsequent processing operations. In the two-step injection molding process, the patterns are individually injected and then placed within an assembly die having sprue, runner and pour cup passages therein. A pour cup insert is placed in the die as in the one-step injection process. Molten wax is injected into the die to form a one-piece pattern assembly comprising the individual patterns connected to the sprue, runners and pour cup. A ceramic ring is then wax welded to the pour cup. The pattern assemblies produced by the disclosed processes are thereafter subjected to conventional shell mold formation operations.

Although an improvement over the prior art practice, the one-step and two-step injection molding processes suffer from several disadvantages. Both processes require that a metal pour cup insert be placed within the die prior to injection of the wax. Both processes also require that a ceramic ring be attached manually to the pour cup to provide location and support means for later operations. Also, neither process is amenable for use in the directional solidification of molten metals wherein the shell mold must have an open bottom to allow a chill plate to contact the molten metal, as taught in the VerSnyder patent, U.S. Pat. No. 3,260,505. This is a serious disadvantage since modern gas turbine engines rely on directionally solidified turbine blades for improved performance characteristics. The two-step process is specifically disadvantageous in that the wax patterns are injection molded individually and must then be transported to and placed within the assembly die for attachment to sprue, runners and pour cup. Further, the joints between the performed wax patterns and sprue are often characterized by objectionable roughness, such as ridges, which are a possible source of casting defects.

Copending application entitled "Method of Making a Unitary Pattern Assembly" of Edward G. Day has a common assignee with the present invention. The invention theredisclosed involves a method of making a unitary pattern assembly comprising providing a fixture, said fixture having first and second pattern capturing means rigidly spaced a predetermined distance from one another; providing a mold structure having a cavity therein; positioning the mold structure and the fixture to expose said capturing means to the cavity; forming a pattern in the cavity, said pattern being fixedly captured at each end by said capturing means; and removing the mold structure from the pattern, said pattern remaining fixedly captured by said capturing means in the fixture. A unitary pattern assembly comprising a fixture and pattern fixedly captured therein is obtained and is useful in forming investment shell molds for the conventional and directional solidification of molten metals and alloys.

SUMMARY OF THE INVENTION

The present invention provides a method of making a unitary pattern assembly which is useful in forming an investment shell mold having an integral base, for the conventional and directional solidification of molten metals and alloys.

It is an object of the invention to provide a method of making a unitary pattern assembly which increases dimensional control of the pattern prior to and during shell mold formation operations and, consequently, increases the yield of satisfactory investment castings.

It is another object of the invention to provide a pattern having a base integral therewith, said base having uniform flatness and dimensions.

It is still another object of the invention to provide a unitary pattern assembly which is readily adapted for use in automated techniques for making investment shell molds.

In the practice of the invention, I provide a yoke, said yoke comprising a support member having two leg members extending therefrom to a distance at least equal to the length of the pattern and thickness of the base to be formed and having thereon pattern capturing means interposed between said leg members; provide a mold structure, said structure having a cavity comprising a pattern section and a base section; position the mold structure and yoke to expose said pattern capturing means to the pattern section and said leg members to the base section of the cavity; form a pattern having a base integral therewith in the cavity, said pattern being fixedly captured as its end by said pattern capturing means and said base being fixedly captured by said leg members; and remove the mold structure from the pattern and integral base, said pattern and base remaining fixedly captured in the yoke. A unitary pattern assembly comprising a yoke and pattern, having an integral base, fixedly captured therein is thus obtained.

If desired, cores, inserts or the like may be incorporated into the pattern by placing them within the pattern section of the mold structure cavity prior to formation of the pattern having an integral base.

These and other objects of the invention will appear from the following description of preferred embodiment which is given here by way of example only and with reference to the following drawing.

DESCRIPTION OF THE PREFERRED EMBODIMENT

In the directional solidification of molten alloys into gas turbine engine blades, the ceramic shell mold is provided with a ceramic base to support it on a chill plate. The base must exhibit uniform flatness and dimension, especially if casting and solidification are conducted in automated equipment. The unitary pattern assembly provided by the method of the invention is particularly well-suited for use in forming shell molds having such a base integral therewith. However, it is equally applicable to other conventional and directional solidification processes wherein an investment shell mold having an integral base is required.

Figure 1:
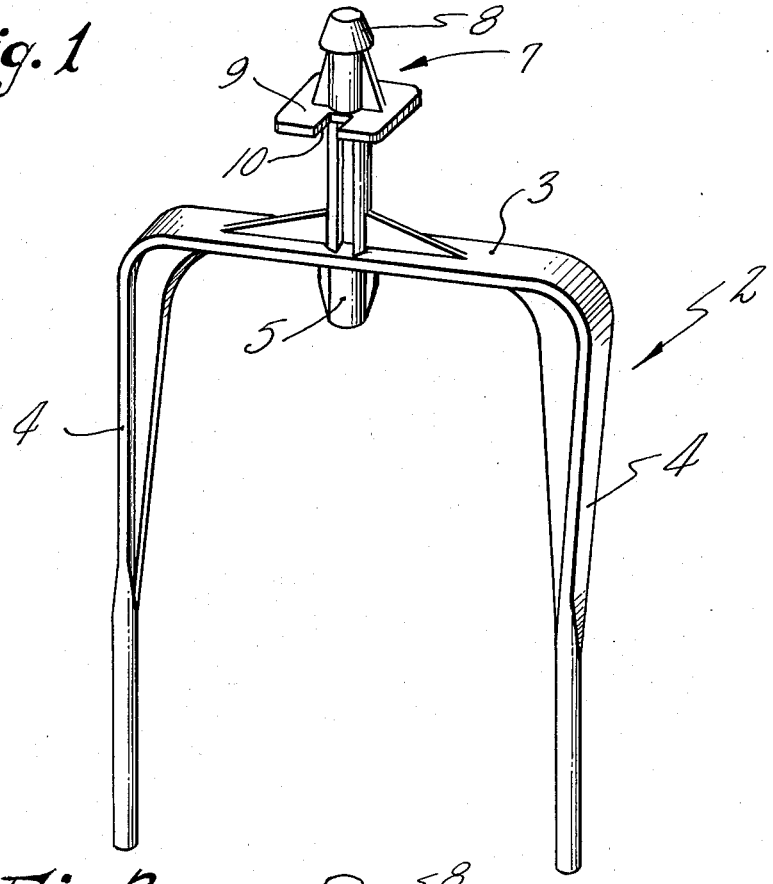
FIG. 1 is a schematic perspective illustration of the yoke of the invention.

Referring to FIG. 1, a yoke 2 is shown as comprising a support member 3 having two leg members 4 extending therefrom to a distance at least equal to the length of the pattern and thickness of the base to be formed and having thereon pattern capturing means 5 interposed between leg members 4. Yoke 2 may be of one-piece construction, such as molded plastic, die cast metal or the like, or may be constructed of individual pieces suitably attached together, such as by bolting, clamping, welding or the like. The configuration and dimension of support member 3 and leg members 4 are selected to provide yoke 2 with sufficient strength and rigidity to resist bending and flexing after the pattern having an integral base is fixedly captured therein.

Preferably, a handle means 7 may be removably attached to yoke 2 or integral therewith to provide a means for manipulating the pattern assembly during shell mold formation and other operations. It may be located in any suitable position on yoke 2 and may be adapted, such as by knob 8 and collar 9, to engage a manipulating device (not shown). Collar 9 may have a notch 10 therein to facilitate orientation in the device.

Figure 2:
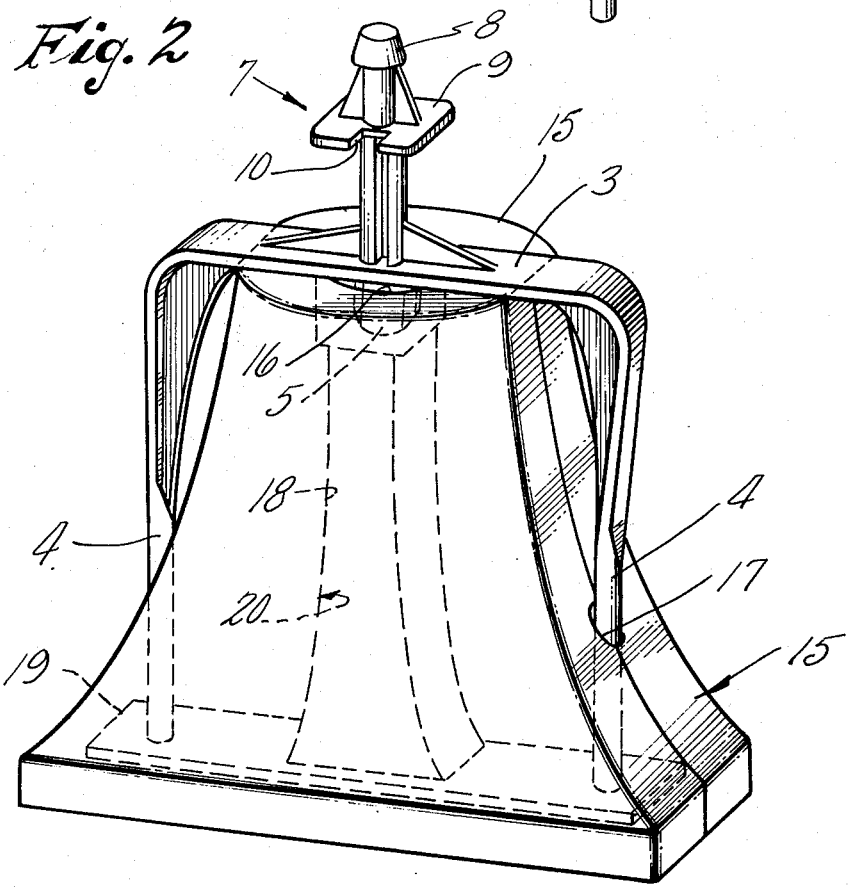
FIG. 2 is a schematic perspective illustration of the yoke and mold structure cooperatively positioned to expose the capturing means and leg members to the cavity.
Figure 3:
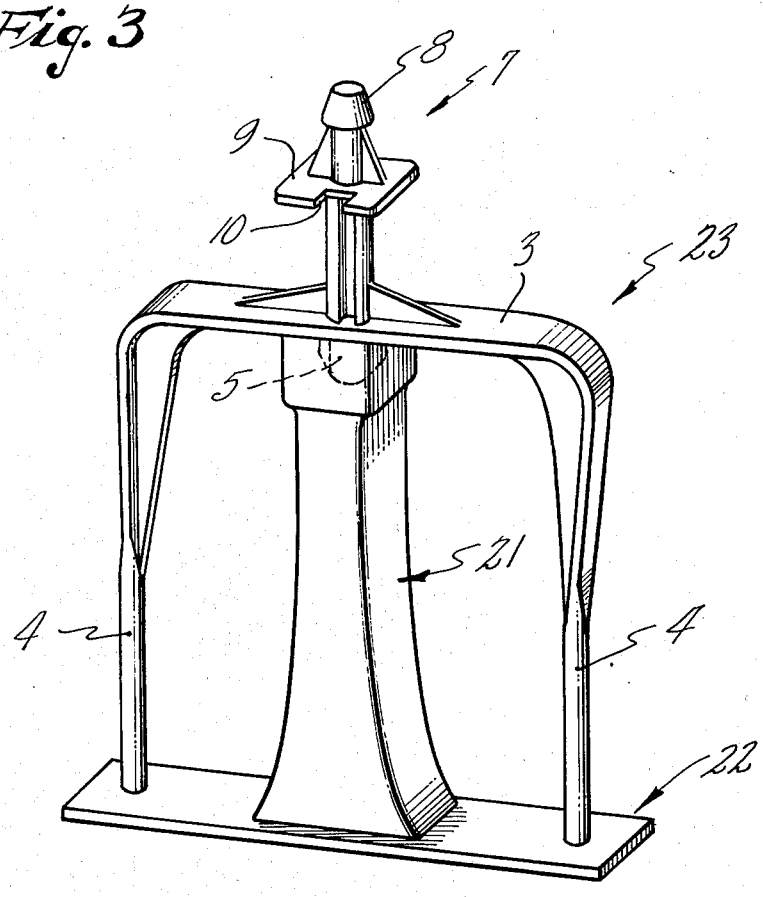
FIG. 3 is a schematic perspective illustration of a unitary pattern assembly comprising a yoke and pattern, having an integral base, fixedly captured therein.

Pattern capturing means 5 may be removably attached to or integral with support member 3 of yoke 2 and is positioned thereon to obtain the desired pattern alignment. As shown in FIGS. 1, 2 and 3, it may be an elongated member, such as a finned cylinder, extending from support member 3 along the axis of the pattern to be formed. Other shapes, such as a cone, rod or the like, are also suitable. Alternatively, the pattern capturing means 5 may be a recess, such as a slot, hole or the like, in support member 3. The recess is constructed so that pattern material cannot escape therethrough. In addition to aligning and anchoring the pattern at one end, as shown in FIG. 3, the pattern capturing means 5 also provides a so-called slip joint where, if needed, the pattern can shrink upon cooling without detaching from its means of support.

In FIGS. 1, 2 and 3, leg members 4 are shown extending from support member 3 to a distance at least equal to the length of the pattern to be formed and thickness of the base to be formed. Upon positioning of the yoke and the mold structure cooperatively, leg members 4 will be exposed through the thickness of base section 19 of cavity 20 and will function as base capturing means. In the preferred practice, leg members 4 project from support member 3 at substantially a 90° angle. However, other angular configurations are of course possible. As mentioned before, leg members 4 and support member 3 are suitably designed to provide yoke 2 with sufficient strength and rigidity to resist bending and flexing after the pattern having an integral base is fixedly captured therein.

Mold structure 15 and yoke 2 are cooperatively positioned so that pattern capturing means 5 is exposed through a suitably disposed opening 16 to the pattern section 18 of cavity 20 and leg members 4 are exposed through suitably disposed openings 17 to the base section 19 of cavity 20. Pattern section 18 is selected to have a shape substantially similar to that of the article to be cast while base section 19 has a suitable configuration to provide a base having a uniformly flat and dimensioned surface in contact with the pattern formed thereon. Base section 19 may be provided with passage means (not shown) for forming a base having strengthening webs and the like on its underside. Mold structure 15 should possess sealing means (not shown) to preclude pattern material from exiting the mold cavity 20 where the capturing means 5 and leg members 4 enter. Mold structure 15 may be comprised of two or more connectable parts to facilitate positioning within yoke 2. Mold structures of the type described are well known in the prior art. After proper positioning is achieved, a pattern 21 having an integral base 22 is formed in cavity 20 of mold structure 15 by introducing pattern material, such as molten wax, therein. The pattern capturing means 5 and leg members 4, exposed within cavity 20, fixedly capture the pattern 21 and base 22, respectively, during their formation. Injection of molten wax into a cavity 20 is the preferred method of forming the pattern 21 having an integral base 22.

If desired, cores, inserts and the like may be incorporated into pattern 21 by placing them within the pattern section 18 of cavity 20 prior to introduction of the pattern material. This technique may be used, for example, in producing turbine blades having cooling passages therein.

To obtain the unitary pattern assembly 23 of FIG. 3, the mold structure 15 is removed from the pattern 21 having an integral base 22, said pattern 21 and base 22 remaining fixedly captured in yoke 2. The pattern assembly 23 may thereafter be transported by handle means 7 to shell mold formation operations, wherein the assembly 23 is repeatedly dipped in a ceramic slurry and dried to form a shell (not shown) thereon. The shelled pattern having an integral shelled base is then separated from the shelled yoke by conventional means, such as sawing or the like, and subjected to dewaxing or like operations. Yoke 2 may then be cleaned to remove the shell thereon and reused in the method of the invention.

At no time after the pattern is formed and fixedly captured in the yoke does it contact anything but the mold cavity and ceramic slurry. In addition, the pattern is subjected to only minimal stresses during shell mold formation operations since it is supported at one end by the pattern capturing means and at the other by the base integral therewith. Since the base is also formed and fixedly captured in the mold cavity and thereafter exposed only to ceramic slurry, it will exhibit uniform flatness and dimension which will be subsequently manifested in the ceramic base formed thereon. The method of the invention thus provides a pattern assembly which can be readily adapted for use in automated techniques for making an investment shell mold having an integral base.

Although the invention has been shown and described with respect to illustrative embodiments thereof, it should be understood by those skilled in the art that the foregoing and various other changes may be made without departing from the scope of the invention.

Having thus described typical embodiments of my invention, that which I claim as new and desire to secure by Letters Patent of the United States is:

1. A method of making a unitary pattern assembly useful in forming an investment shell mold having an integral base, for the conventional and directional solidification of molten metals and alloys comprising the steps of:

a. providing a yoke, said yoke comprising a support member having two leg members extending therefrom to a distance at least equal to the length of the pattern and thickness of the base to be formed and having thereon pattern capturing means interposed between said leg members;

b. providing a mold structure, said structure having a cavity comprising a pattern section and base section;

c. positioning the mold structure and yoke to expose said pattern capturing means to the pattern section and said leg members to the base section of the cavity;

d. forming a pattern having a base integral therewith in said cavity, said pattern being fixedly captured at its end by said pattern capturing means and said base being fixedly captured by said leg members; and e. removing the mold structure from the pattern and integral base, said pattern and integral base remaining fixedly captured in the yoke.

2. The method of claim 1 wherein said pattern capturing means is an elongated member extending from the support member along the axis of the pattern to be formed.

3. The method of claim 2 wherein said member is in the shape of a finned cylinder.

4. The method of claim 1 wherein said pattern capturing means is provided by said support member having a recess therein.

5. The method of claim 1 wherein said leg members project at substantially a 90° angle from said support member.

6. The method of claim 1 wherein said yoke is provided with handle means.

7. The method of claim 6 wherein said handle means is adapted to engage a manipulating device.

8. The method of claim 1 wherein the pattern section of said cavity is substantially in the shape of a gas turbine engine blade.

9. The method of claim 1 wherein an insert is placed in the pattern section of the cavity prior to forming the pattern and integral base.

10. The method of claim 1 wherein the pattern and integral base are formed from molten wax injected into the cavity.

* * * * *